US005548105A

United States Patent [19]

Butterworth et al.

[11] Patent Number: 5,548,105

[45] Date of Patent: Aug. 20, 1996

[54] UNIVERSAL MAGNETRON ASSEMBLY FOR MICROWAVE OVEN

[75] Inventors: William Butterworth, Batavia, Ill.; Clyde H. Powell, Chattanooga, Tenn.

[73] Assignee: Fidelitone Inc., Wauconda, Ill.

[21] Appl. No.: 499,859

[22] Filed: Jul. 10, 1995

[51] Int. Cl.[6] ..... H01J 23/10; H05B 6/64

[52] U.S. Cl. ..... 219/761; 219/748; 219/757; 315/39.51

[58] Field of Search ..... 219/761, 756, 219/757, 748; 315/39.51, 39.53, 39.63

[56] References Cited

U.S. PATENT DOCUMENTS

| | | | |
|---|---|---|---|
| 3,223,881 | 12/1965 | Krug, Jr. | 315/39.53 |
| 3,325,678 | 6/1967 | Krug, Jr. et al. | 315/39.51 |
| 3,562,471 | 2/1971 | White | 219/748 |
| 3,809,486 | 5/1974 | Foerstner | 403/374 |
| 4,028,521 | 6/1977 | Uyeda et al. | 219/749 |
| 4,434,042 | 2/1984 | Keith | 204/298 |
| 4,463,239 | 7/1984 | Miller | 219/749 |
| 4,701,586 | 10/1987 | Hagberg | 219/761 |
| 4,956,531 | 9/1990 | Braunisch et al. | 219/757 |
| 5,391,964 | 2/1995 | Lim | 315/39.51 |

*Primary Examiner*—Philip H. Leung

*Attorney, Agent, or Firm*—Mason, Kolehmainen, Rathburn & Wyss

[57] ABSTRACT

A magnetron assembly that is adapted to be mounted on a wall of a waveguide in a microwave oven includes a yoke enclosure in which is disposed a magnetron tube. The yoke enclosure is generally U-shaped with an open top end and open opposite ends to permit air flow through the yoke enclosure and past circular disc shaped cooling fins that are affixed only to an anode assembly about the magnetron tube. Different configured mounting plates can be detachably disposed in the open top end of the yoke enclosure. A filter box has input power terminals for the magnetron tube extending therefrom and is mounted with respect to a bottom wall of the yoke enclosure such that the yoke enclosure can be rotated to various positions relative to the input terminals extending from the filter box. The mounting plates, the yoke enclosure and the filter box can be configured with respect to each other in order that the magnetron assembly can be mounted in different microwave ovens even though the microwave ovens have different mounting configuration requirements. In an alternate embodiment of the present invention, the filter box is formed of inner and outer cups with the inner cup being rotatably mounted within the outer cup. The input terminals for the magnetron tube project from the inner cup through an elongated opening in the outer cup such that the input terminals can be rotated to different positions relative to the yoke enclosure.

20 Claims, 6 Drawing Sheets

UNIVERSAL MAGNETRON ASSEMBLY FOR MICROWAVE OVEN

BACKGROUND OF THE INVENTION

1. Field of the Invention

The present invention generally relates to a magnetron assembly that is adapted to be mounted in a microwave oven, and, more particularly, to a new and improved magnetron assembly that has multiple mounting configurations so as to be adapted to be mounted within microwave ovens having different mechanical orientation requirements for magnetron assemblies.

2. Description of the Prior Art

Magnetrons are mounted within microwave ovens so that microwave energy generated by a magnetron tube within the assembly can be used for cooking purposes. Typically, the magnetron assembly includes a yoke enclosure in which is housed the magnetron tube. An antenna extends from one end of an anode portion of the magnetron tube through a top mounting plate affixed to the yoke enclosure and a filament stem extends from the opposite, bottom end of the magnetron tube into a filter box attached to the lower portion of the yoke enclosure. Input terminals project from the filter box in order to couple a choke within the filter box to a source of potential for operating the magnetron tube. When the magnetron tube is operated, a considerable amount of heat is generated about the magnetron tube and thereby within the yoke enclosure. In order that the magnetron tube is maintained at a cool enough operating temperature, opposite sides of the yoke enclosure are open to form vents so that air flowing through the vents flow past cooling fins that are disposed about the anode portion of the magnetron tube to thereby maintain the magnetron tube at an appropriate operating temperature.

Microwave energy generated by the magnetron tube is radiated from the antenna of the magnetron tube into a cooking cavity of the microwave oven via a waveguide into which the antenna extends. The magnetron assembly needs to be mounted within the microwave oven such that the antenna protrudes through a wall of the waveguide. Typically, the mounting plate on the magnetron assembly is used to mount of the magnetron assembly to a wall of the waveguide. The mounting plate may include threaded holes, unthreaded holes or permanent studs for securing the mounting plate and thus the magnetron assembly to the wall of the waveguide. These holes or studs often are located in mounting ears that extend out from opposite edges of the mounting plate.

Conventional magnetrons are manufactured in a rigid assembly with the mounting ears of the mounting plate, the airflow path and the filament leads being in a particular configured relationship with respect to each other. For example, the mounting ears, the airflow path and input terminals all can be in alignment with respect to each other; the mounting ears and airflow path can be in alignment with each other while the input terminals extend generally transverse to the mounting ears and the airflow path; the airflow path and the input terminals can be in alignment with each other while the mounting ears extend transverse to the airflow path and the input terminals; or the mounting ears and the input terminals can be in alignment with the airflow path that is generally transverse to the mounting ears and the input terminals. As can be appreciated, a different magnetron assembly is required for each different microwave mounting configuration when rigid assembly magnetron assemblies are utilized. Accordingly, it would be advantageous to be have one universal magnetron assembly that can be used in a number of different microwave oven mounting configurations.

SUMMARY OF THE INVENTION

Accordingly, an object of the present invention is to provide a new and improved magnetron assembly that can be utilized in a number of different mounting configurations within different microwave ovens. Other objects of the present invention are to provide a new and improved magnetron assembly for mounting in a microwave oven where the yoke enclosure and filter box are rotatable with respect to each other so that the magnetron assembly can be adapted to be mounted in microwave ovens having different mounting configuration requirements; to provide a new and improved magnetron assembly for a microwave oven having a circular cooling fin design that permits the yoke enclosure to be rotated with respect to the magnetron tube; to provide a new and improved magnetron assembly that includes a plurality of interchangeable mounting plates so that the magnetron can be mounted in different orientations within a microwave oven; and to provide a new and improved magnetron assembly that includes a filter box that is rotated with respect to the yoke enclosure to permit the magnetron to be oriented properly within a given microwave oven.

In accordance with these and many other objects of the present invention, the present invention is embodied in a magnetron assembly that is adapted to be mounted on a wall of a waveguide in a microwave oven so that microwave energy generated by a magnetron tube in the magnetron assembly is directed into a cooking chamber of the microwave oven from an antenna that projects from the magnetron assembly into the waveguide. The magnetron assembly includes a yoke enclosure in which is disposed the magnetron tube. The yoke enclosure is generally U-shaped with an open top end and open opposite ends to permit air flow through the yoke enclosure and past circular disc shaped cooling fins that are mounted on an anode assembly about the magnetron tube.

A mounting plate is detachably disposed in the open top end of the yoke enclosure. The mounting plate includes a central opening through which projects the antenna from the magnetron tube. A bottom wall of the yoke enclosure has a central opening through which extends a filament stem from the magnetron tube. A filter box has input power terminals for the magnetron tube extending from the filter box and is mounted rotatably with respect to the bottom wall of the yoke enclosure such that the yoke enclosure can be rotated to various positions relative to the input terminals extending from the filter box. The yoke enclosure can be rotated with respect to the filter box in part due to the fact that the cooling fins are attached only to the anode assembly and not to the outer wall of the yoke enclosure.

Different mounting plates can be secured in the top end of the yoke enclosure. As a result, the mounting plates (in particular mounting ears that project from the mounting plates), the yoke enclosure (in particular the direction of the air flow through the open side ends of the yoke enclosure) and the filter box (in particular the direction the input terminals extend from the filter box) can be configured with respect to each other in order that the magnetron assembly can be mounted in different microwave ovens even though the microwave ovens have different mounting configuration requirements.

In an alternate embodiment of the present invention, the filter box is formed of inner and outer cups with the inner cup being rotatably mounted within the outer cup. The inner cup has an oval opening in its sidewall in which is mounted a filter capacitor with the input power terminals projecting therefrom. The sidewall of the outer cup includes an elongated opening through which projects the filter capacitor and the input terminals. As a result, the input terminals can be rotated to different positions relative to the yoke enclosure depending on the configuration requirements for a particular microwave oven.

BRIEF DESCRIPTION OF THE DRAWING

The present invention, together with the above and other objects and advantages, can best be understood from the following detailed description of the embodiment of the invention illustrated in the drawing, wherein.

DETAILED DESCRIPTION OF THE PREFERRED EMBODIMENT

Figure 1:
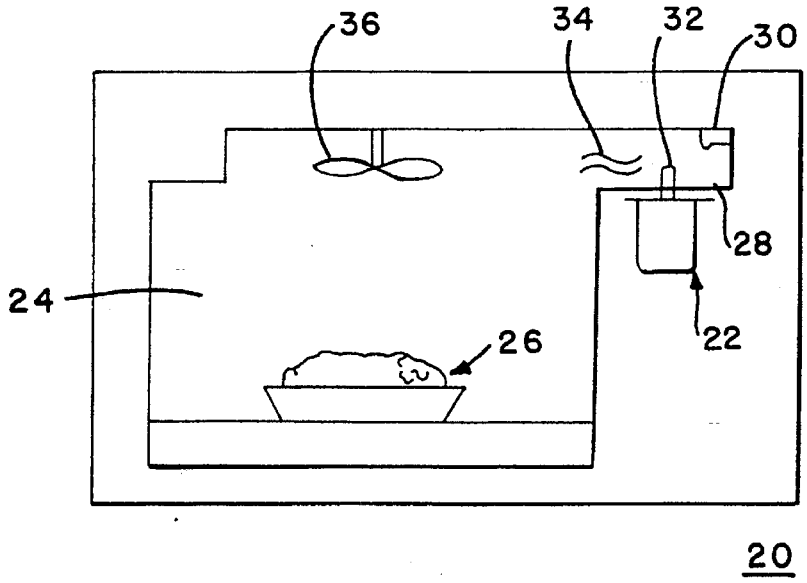
FIG. 1 is a diagrammatic view illustrating a magnetron assembly mounted in a microwave oven.

Referring now more specifically to FIG. 1 of the drawings, therein is shown diagrammatically a microwave oven 20 having therein a magnetron assembly generally designated by the reference numeral 22, which magnetron assembly 22 embodies the present invention. The microwave oven 20 includes a cooking chamber 24 in which an object 26 is disposed so that it can be heated. The magnetron assembly 22 is mounted on a wall 28 of a waveguide 30 such that an antenna portion 32 projecting from the magnetron assembly 20 is in part disposed within the waveguide 30. Microwave energy generally represented by waves 34 and generated by the magnetron assembly 22 is directed into the cooking chamber 24 from the antenna portion 32 via the waveguide 30. A stirring device 36 can be provided with respect to the cooking chamber 24 to more evenly distribute the microwave energy throughout the cooking chamber 24.

Figure 2:
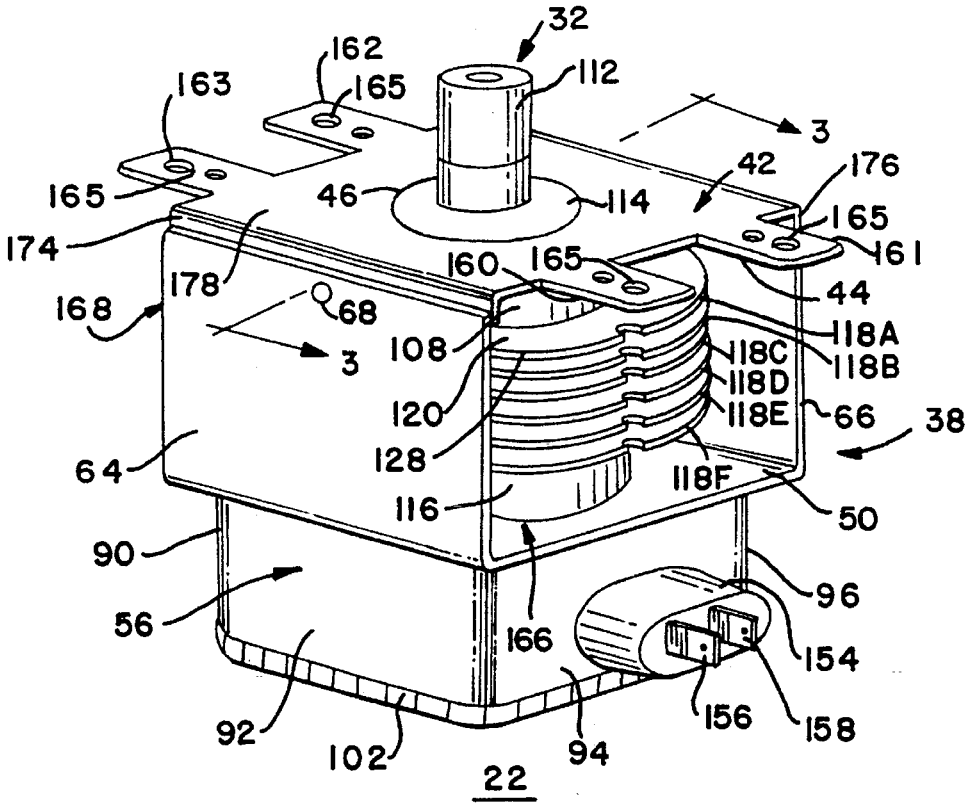
FIG. 2 is a perspective view of a magnetron assembly embodying the present invention.
Figure 3:
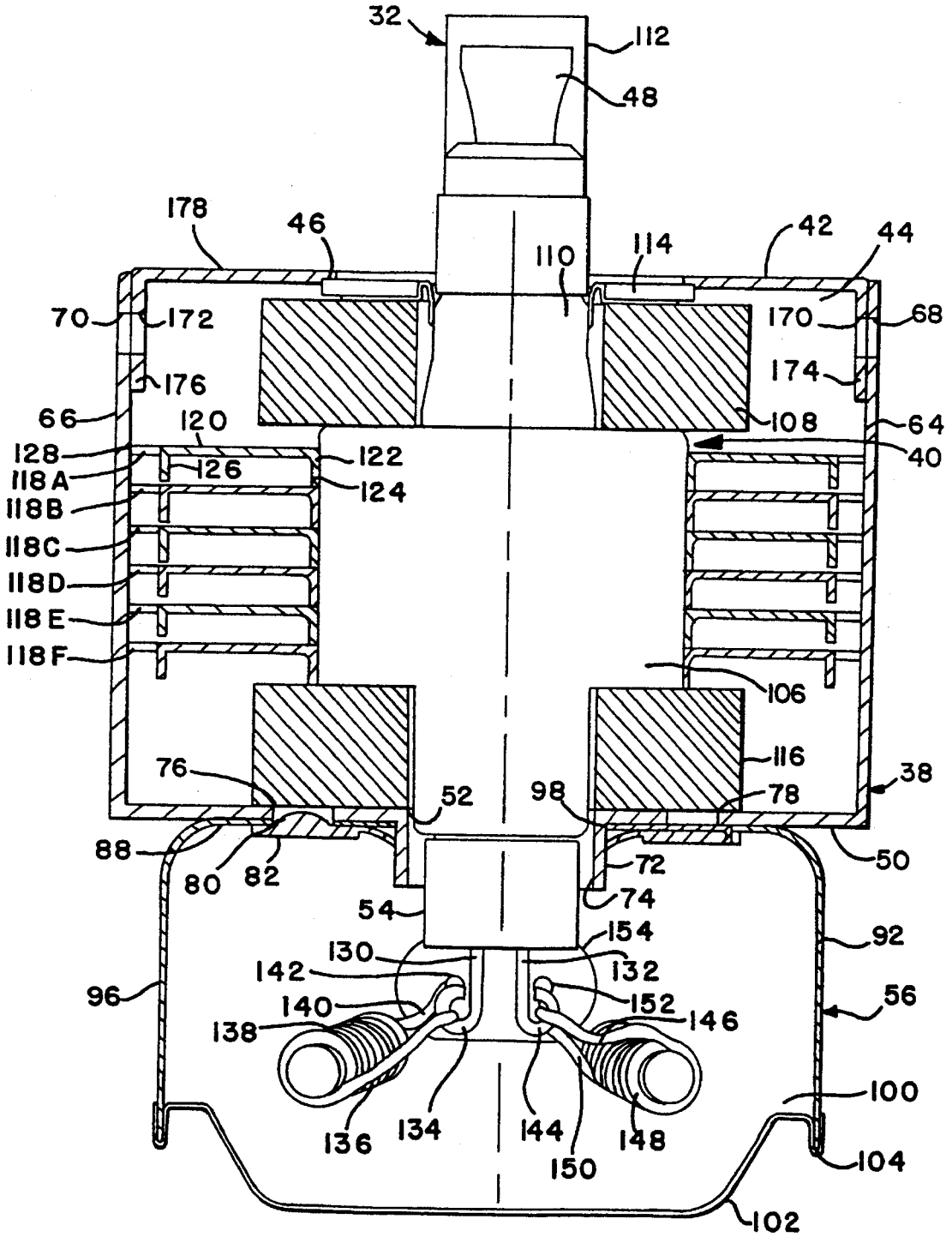
FIG. 3 is a cross sectional view of the magnetron assembly of FIG. 2 taken along line 3—3 of FIG. 2.
Figure 4:
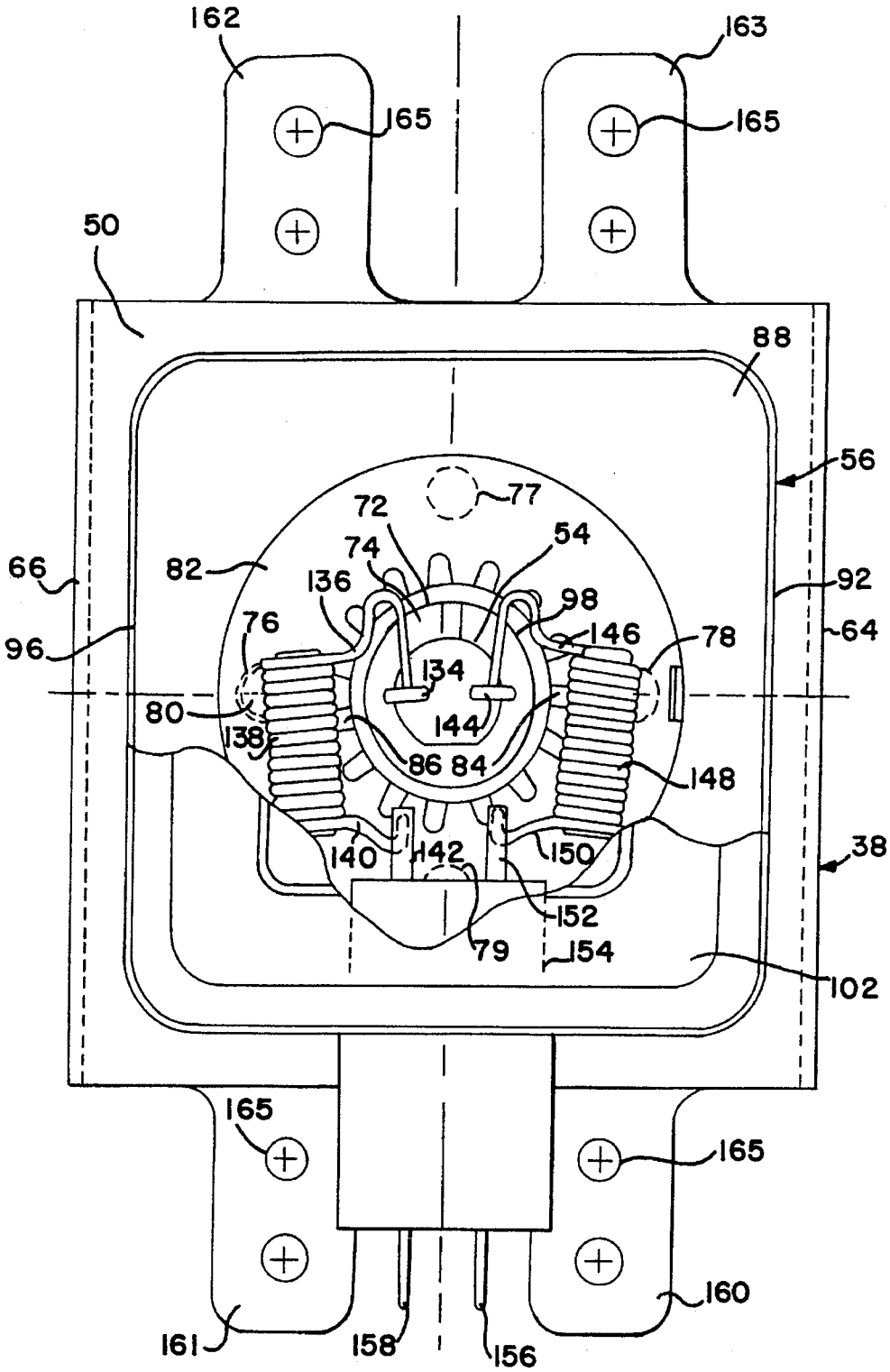
FIG. 4 is a bottom plan view of the magnetron assembly of FIG. 2, with the bottom wall partially cut away.

The magnetron assembly 22 is more specifically shown in FIGS. 2–4 of the drawings and includes a yoke enclosure 38 in which is disposed a magnetron tube 40. A mounting plate 42 is detachably disposed in an open top end 44 of the yoke enclosure 38 so as to substantially close the top end 44 of the yoke enclosure 38. The mounting plate 42 includes a central opening 46 through which projects an antenna 48 from the magnetron tube 40. A bottom wall 50 of the yoke enclosure 38 has a central opening 52 through which extends a filament stem 54 from the magnetron tube 40. A filter box 56 is mounted rotatably with respect to the bottom wall 50. As will be discussed in more detail below, the yoke enclosure 38 can be positioned relative to the filter box 56 and different mounting plates 42, 58–62 (FIG. 5) can be secured in the top end 44 of the yoke enclosure 38 so that the mounting plates 42, 58–62, the yoke enclosure 38 and the filter box 56 can be configured with respect to each other in order that the magnetron assembly 22 can be mounted in a microwave oven even though individual microwave ovens like the microwave oven 20 have different mounting configuration requirements.

The yoke enclosure 38 is a generally U-shaped enclosure having opposed side walls 64 and 66 extending upwardly from the bottom wall 50. The wall 64 includes a mounting hole 68 near the top end 44 of the yoke enclosure 38 and the wall 66 includes a similar mounting hole 70 near the top end 44 of the yoke enclosure 38. The mounting holes 68 and 70 are used to secure the mounting plates 42, 58–62 in the top end 44 of the yoke enclosure 38. The bottom wall 50 of the yoke enclosure 38 has a flange 72 extending downwardly from the central opening 52 to form a conduit 74 which projects into the filter box 56 and through which extends the filament stem 54. The bottom wall 50 additionally has detent holes 76–79 (FIGS. 3–4) that are adapted to receive a detent 80 projecting from a serrated washer 82 that maintains the filter box 56 secured to the yoke enclosure 38. In this regard, the washer 82 has resilient fingers, such as the fingers 84 and 86 (FIGS. 3–4), that are forced against the flange 72 to maintain a top wall 88 of the filter box 56 against the bottom wall 50 of the yoke enclosure 38. While the serrated washer 82 secures the filter box 56 to the yoke enclosure 38, it also permits the yoke enclosure 38 to be rotated with respect to the filter box 56 to various rotated positions wherein the detent 80 becomes lodged in one of the detent holes 76–79.

The filter box 56 is generally in the shape of an inverted rectangular enclosure with side walls 90, 92, 94 and 96 extending downwardly from the top wall 88. The top wall 88 has a central opening 98 through which extends the flange 72 when the filter box 56 is secured to the yoke enclosure 38 by the washer 82. The lower open end 100 is closed by a filter box cover 102 that has a retaining groove 104 for receiving and retaining the side walls 90, 92, 94 and 96 of the filter box 56 to thereby retain the cover 102 on the filter box 56.

The yoke enclosure 38 is adapted to house the magnetron tube 40. An anode assembly 106 surrounds the outer central periphery of the magnetron tube 40. A donut shaped ceramic magnetic 108 is disposed about an antenna stem 110 that extends from the magnetron tube 40 through the opening 46 in the top end 44 of the yoke enclosure 38 into an antenna cap 112 that encloses the antenna 48. The portion of the opening 46 not occupied by the antenna stem 110 is sealed from radio frequencies by an RF gasket 114 that encircles the antenna stem 110 and is disposed between the ceramic magnetic 108 and the mounting plate 42. Another ceramic magnetic 116 is disposed about the filament stem 54 and is disposed between the lower end of the anode assembly 106 and the bottom wall 50 of the yoke enclosure 38.

When the magnetron tube 40 is operated, heat is generated that tends to radiate outwardly through the anode assembly 106. If the heat that is so generated is not dissipated, the magnetron tube 40 can be damaged. In order to so dissipate the heat that is being generated, cooling fins 118A–118F are disposed about the anode assembly 106. As is the case with respect to the cooling fin 118A, each of the cooling fins 118A–118F includes a circular disc shaped portion 120 having a central bore 122 formed by a depending flange 124. The cooling fin 118A additionally includes a depending leg 126 that is disposed adjacent an outer peripheral edge 128 of the disc shaped portion 120. As is illustrated in FIG. 3 of the drawings, the flange portions 124 and the depending legs 126 space the adjacent cooling fins 118A–118F in proper spatial relationship with respect to each other. The cooling fins 118A–118F are disposed about the anode assembly 40 with the anode assembly 40 disposed within the bores 122 formed by the flange portions 124. The flange portions 124 are affixed to the anode assembly 40 whereas the outer peripheral edges 128 of the disc portions 120 are not secured to the yoke enclosure 38. As a result, the yoke enclosure 38 can be rotated with respect to the magnetron tube 40 and the cooling fins 118A–118F attached to the anode assembly 106 of the magnetron tube 40.

The filter box 56 is disposed against the bottom wall 50 of the yoke enclosure 38 and provides an interface between a power supply (not shown) for the magnetron tube 40 and the magnetron tube 40. As previous indicated, the filament stem 54 extends from the magnetron tube 40 through the conduit 74 into the filter box 56. A pair of conductors 130 and 132 extend through the filament stem 54 from the filament (not shown) of the magnetron tube 40. The conductor 130 terminates in a connecting portion 134 that is coupled to one end 136 of choke windings 138. The other end 140 of the windings 138 is coupled to a terminal 142. The conductor 132 similarly terminates in a connecting portion 144 that is coupled to one end 146 of choke windings 148. The other end 150 of the windings 148 is coupled to a terminal 152. The terminals 142 and 152 in turn are coupled to a feed-thru capacitor 154 that is mounted through the side wall 94 of the filter box 56. The capacitor 154 has a pair of input terminals 156 and 158 that are adapted to be coupled to a source of potential for operating the magnetron tube 40.

As shown in FIGS. 2 and 4, the mounting plate 42 covering the top open end 44 of the yoke enclosure 38 has outwardly extending mounting ears 160–163. Each of the mounting ears 160–163 has holes 165 through which can be extended fasteners (not shown) for securing the mounting plate 42 and thereby the magnetron assembly 22 to the wall 28 of the waveguide 30.

As also is apparent from FIGS. 2 and 4, the mounting ears 160–163 extend, the terminals 156 and 158 on the feed-thru capacitor 154 extend and air flowing through opposed open sides 166 and 168 of the yoke enclosure 38 flow in the same direction as an axis extending through the open sides 166 and 168. This permits air to flow through the open sides 166 and 168 past the cooling fins 118A–118F in the same direction as the mounting ears 160–163 extend from the mounting plate 42 and the input terminals 156 and 158 extend from the capacitor 154. As is previously discussed, different microwave ovens have different configuration requirements for the mounting plate that is used on the magnetron assembly 22 and the relative positions of the mounting ears 160–163, the open sides 166 and 168 of the yoke enclosure 38 and the input terminals 156 and 158. If the mounting plate 42 and the filter box 56 were rigidly mounted to the yoke enclosure 38, a different magnetron assembly 22 would have to be obtained for each different configuration that is required for a particular microwave oven. On the other hand, the magnetron assembly 22 enables a single universal unit to be used for microwave ovens having different configuration requirements.

More specifically, the relative position of the filter box 56 and the yoke enclosure 38 can be adjusted due to the fact that the yoke enclosure 38 is rotatable with respect to the filter box 56. As shown in FIG. 3, the detent 80 on the washer 82 is located in the detent hole 76. When the detent 80 is so located in the detent hole 76, the input terminals 156 and 158 extend in the same direction as the axis that extends through the open sides 166 and 168 of the yoke enclosure 38 (this is the configuration illustrated in FIGS. 2 and 3 of the drawings).

In some microwave ovens, it is necessary to have the input terminals 156 and 158 extend transversely of the axis extending through the open sides 166 and 168 of the yoke enclosure 38 or in other words, transversely to the side walls 64 and 66. In such a situation, the yoke enclosure 38 is rotated with respect to the filter box 56. This is accomplished by placing a rotating force against the yoke enclosure 38 while maintaining the filter box 56 stationary. As a result, the detent 80 becomes dislodged from the detent hole 76 and the flange 72 is rotated within the fingers 84, 86 on the washer 82 while the top wall 42 of the yoke enclosure 38 is permitted to rotate about the antenna stem 110 due to the gasket 114. The yoke enclosure 38 is permitted to continue to be rotated until the detent 80 becomes lodged in the next detent hole, for example the detent hole 79 if the yoke enclosure 38 is rotated in a clockwise direction as viewed in FIG. 3. This rotation of the yoke enclosure 38 is in part permitted because the cooling fins 118A–118F are formed of circular disc portions 120 that are secured only to the anode assembly 106 and not to the side walls 64 and 66 of the yoke enclosure 38 as compared to rectangular shaped fins in a fixed or rigid type magnetron assembly that are attached to the anode assembly 106 as well as the side walls 64 and 66 of the yoke enclosure 38. As can be appreciated, the fact that the yoke enclosure 38 can be rotated vis-a-vis the filter box 56 enables the air flow path through the open sides 166 and 168 of the yoke enclosure 38 to be either in parallel to or transverse to the direction that the input terminals 156 and 158 extend from the filter box 56.

In addition to having the input terminals 156 and 158 extend in a specific direction with respect to the air flow path through the open sides 166 and 168 of the yoke enclosure 38, it is necessary to be able to have different mounting plates (as for example, mounting plates 42 and 58–52) disposed in the open top end 44 of the yoke enclosure 38. These different mounting plates 42, 58–62 provide different mounting configurations for securing the magnetron assembly 22 to the wall 28 of the waveguide 30 in the microwave oven 20.

As is discussed above with respect to FIG. 2, the mounting plate 42 is secured in the open end 44 of the yoke enclosure 38 by fasteners (not shown) that extend through the holes 68 and 70 in the side walls 64 and 66 respectively and into corresponding holes 170 and 172 in skirts 174 and 176 extending downwardly from a top side 178 of the mounting plate 42. The mounting plate 42 includes the mounting ears 160–163 that, as shown in FIG. 2, extend from the top side 178 in a direction generally parallel to the axis extending through the open sides 166 and 168. The mounting ears 160–163 each have mounting holes 165 through which fasteners (not shown) can be extended into the wall 28 of the waveguide 30 for securing the magnetron assembly 22 to the wall 28. Other mounting configurations for the magnetron assembly 22 are provided by the other mounting plates 58–62 (FIG. 5).

Figure 5:
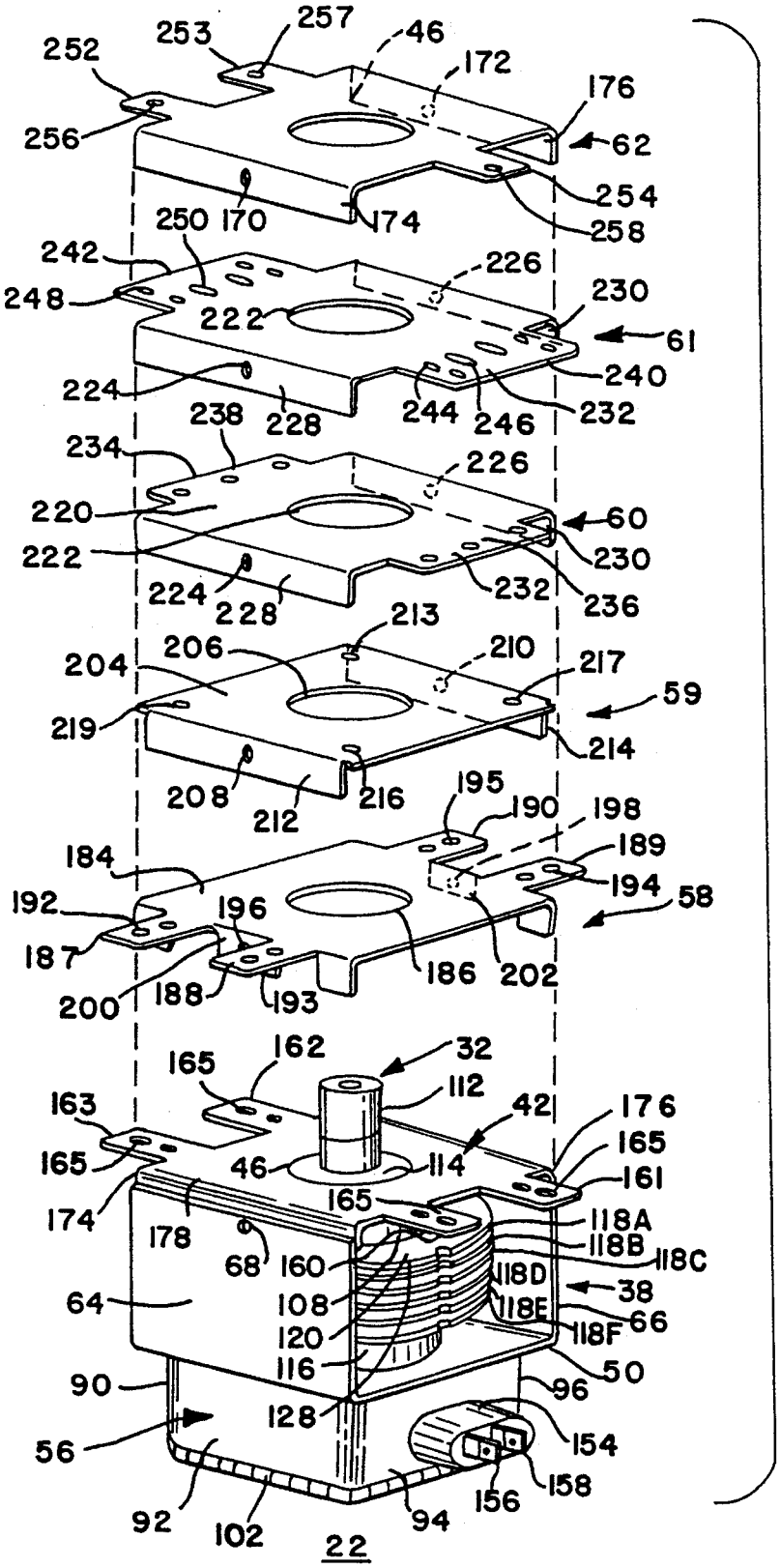
FIG. 5 is a perspective view of the magnetron assembly of FIG. 2 with alternate mounting plates being illustrated in an exploded manner above the magnetron assembly.

With more specific reference to FIG. 5 of the drawings, the mounting plate 58 is configured similar to the mounting plate 42 in that it includes a top wall 184 having a central access opening 186 through which the antenna 48 is extended. The mounting plate 58 also has laterally extending mounting ears 187–190 that extend from the top wall 184. The mounting ears 187–190 have respectively mounting holes 192–195 so that the mounting plate 58 can be secured to the wall 28 of the waveguide 30. When the mounting plate 58 is secured in the top end 44 of the yoke enclosure 38 by fasteners (not shown) extending through holes 196 and 198 in depending skirts 200 and 202 into the corresponding holes 68 and 70 in the side walls 64 and 66 of the yoke enclosure 38, the mounting ears 187–190 extend transversely to the side walls 64 and 66 as is illustrated in FIG. 5 of the drawings. Hence, the mounting plate 58 is configured essentially the same as the mounting plate 42, but with its mounting ears 187–190 extending in a direction transverse to the mounting ears 160–163 on the mounting plate 42.

In certain instances, the mounting of the magnetron assembly 22 does not necessarily require mounting ears extending laterally from the mounting plate, but instead requires mounting holes in the mounting plate itself. One such type of mounting plate is the mounting plate 59 (FIG. 5). The mounting plate 59 has a top wall 204 with a central access opening 206 through which the antenna 48 can extend and is secured in the top end 44 of the yoke enclosure 38 by fasteners (not shown) extending through holes 208 and 210 in depending skirts 212 and 214 into the corresponding holes 68 and 70 in the side walls 64 and 66 of the yoke enclosure 38. In order to secure the mounting plate 59 to the wall of 28 of the waveguide 30, mounting holes 216–219 are provided in the top wall 204 through which fasteners can be extended from or into the wall 28.

The mounting plate 60 provides still another configuration for mounting the magnetron assembly 22 in the microwave oven 20. The mounting plate 60 has a top wall 220 with a central access opening 222 through which the antenna 48 can extend and is secured in the top end 44 of the yoke enclosure 38 by fasteners (not shown) extending through holes 224 and 226 in depending skirts 228 and 230 into the corresponding holes 68 and 70 in the side walls 64 and 66 of the yoke enclosure 38. Somewhat different than the mounting plates 42 and 58, the mounting plate 60 has a single elongated mounting ear 232 and 234 extending from each of opposite sides of the top wall 220. The mounting ear 232 has mounting holes 236 and the mounting ear 234 has mounting holes 238 through which fasteners (not shown) can be extended from or into the wall 28.

The mounting plate 61 is similar in configuration to the mounting plate 60 except for the configuration of mounting ears 240 and 242. Consequently, the components of the mounting plate 61 are referenced by the same reference numerals as the corresponding components of the mounting plate 60. The mounting ear 240 includes mounting holes 244 and slotted openings 246 and similarly the mounting ear 240 includes mounting holes 248 and slotted openings 250. The mounting plate 61 thereby allows the position of the magnetron assembly 22 to be adjusted somewhat when fasteners are inserted from or into the wall 28 of the waveguide 30.

Another mounting plate 62 is shown in FIG. 5. The mounting plate 62 is similar in configuration to the mounting plate 42 except for the configuration of mounting ears 252–254. Consequently, the components of the mounting plate 62 are referenced by the same reference numerals as the corresponding components of the mounting plate 42. The mounting ears 252–254 include respectively mounting holes 256–257 and extend in a direction parallel to the axis of the air flow through the open sides 166 and 168 of the yoke enclosure 38 when the mounting plate 62 is disposed in the top end 44 of the magnetron assembly 22.

Figure 6:
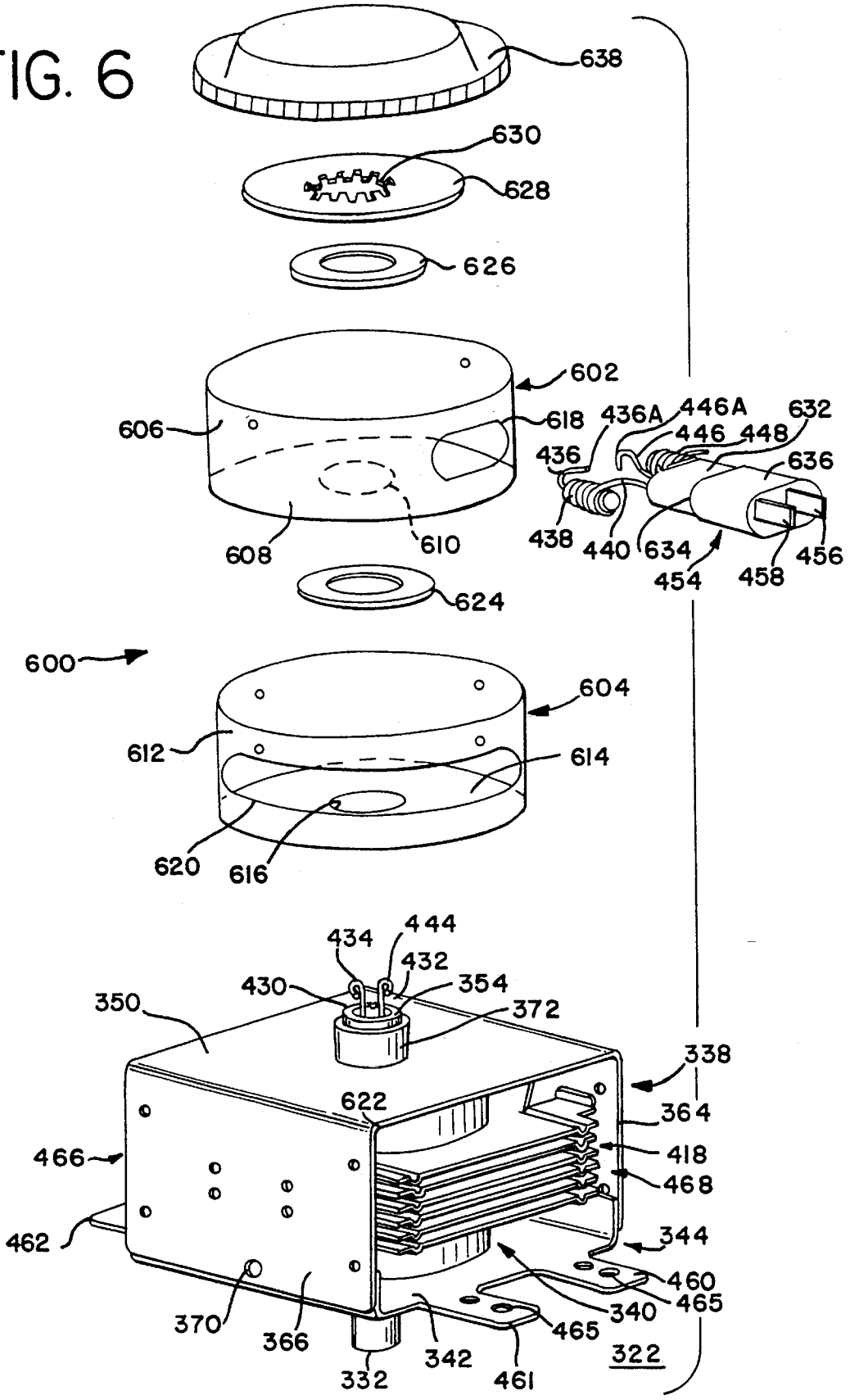
FIG. 6 is an exploded perspective view of a alternate embodiment of the magnetron assembly embodying the present invention.
Figure 7:
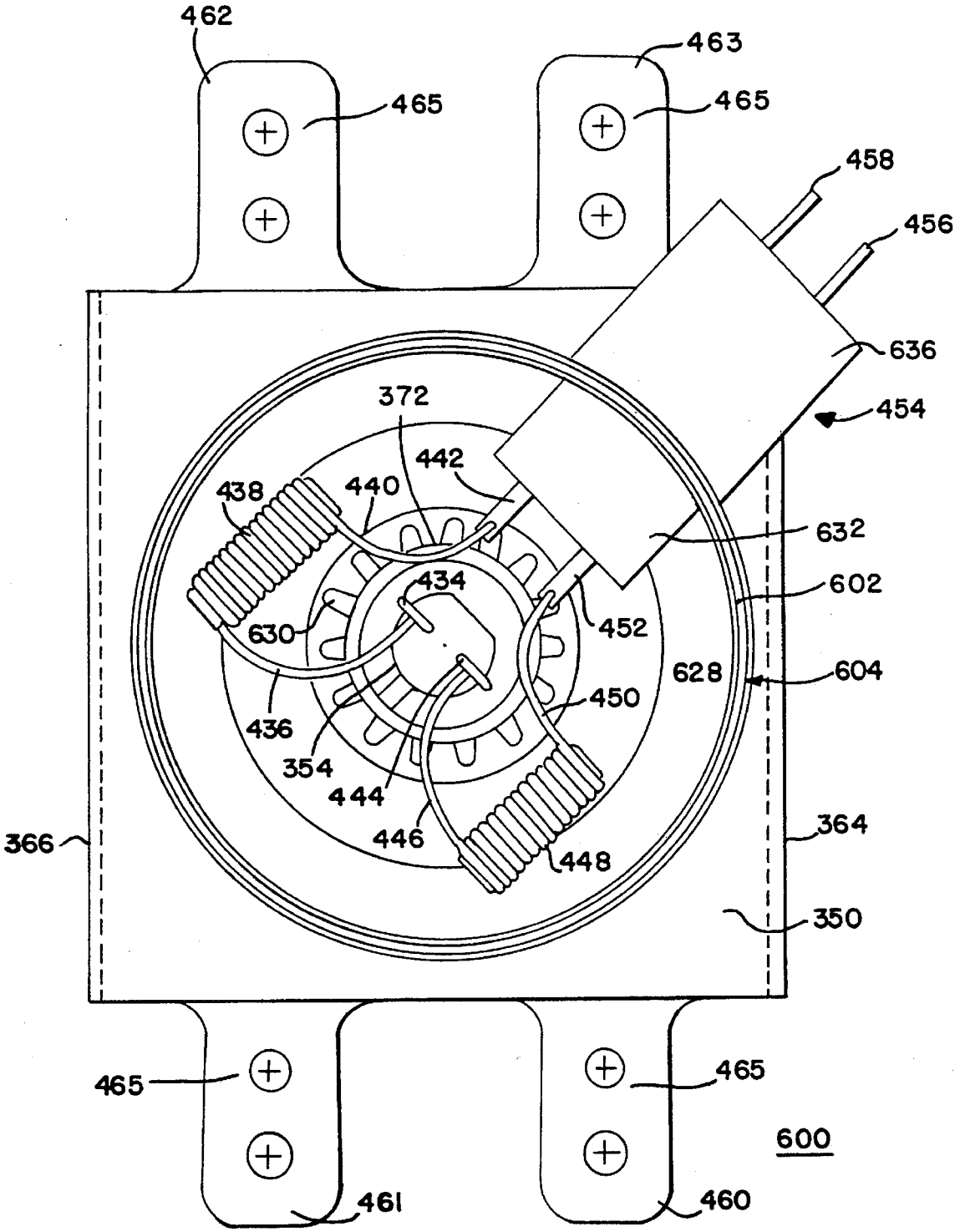
FIG. 7 is a bottom view of the magnetron assembly of FIG. 6.

An alternate embodiment of the magnetron assembly embodying the present invention is disclosed in FIGS. 6 and 7 and is generally designated by the reference numeral 322. The magnetron assembly 322 includes many of the same components as the magnetron assembly 22. Consequently, the components of the magnetron assembly 322 that are specifically referred to herein are referenced by the same reference numeral as corresponding components in the magnetron assembly 22 except that the quantity 300 has been added to the reference numerals for each of the corresponding components in the magnetron assembly 322.

The magnetron assembly 322 is more specifically shown in FIGS. 6–7 of the drawings and includes a yoke enclosure 338 in which is disposed a magnetron tube 340. A mounting plate 342 is detachably disposed in an open top end 344 of the yoke enclosure 338 so as to substantially close the top end 344 of the yoke enclosure 338. It is noted in this regard that the magnetron assembly 322 is illustrated in an inverted fashion in FIG. 6 so as to better illustrate the components of the magnetron assembly 322. A filament stem 354 from the magnetron tube 340 extends from a bottom wall 350 of the yoke enclosure 338. A filter box 600 is mounted rotatably with respect to the bottom wall 350. As will be discussed in more detail below, the filter box 600 can be positioned relative to the yoke enclosure 338 and different mounting plates, such as the mounting plates 58–62 shown in FIG. 5, can be secured in the top end 344 of the yoke enclosure 338 so that the mounting plates 342 or 58–62, the yoke enclosure 338 and the filter box 600 can be configured with respect to each other in order that the magnetron assembly 322 can be mounted in different microwave ovens even though individual microwave ovens like the microwave oven 20 have different mounting configuration requirements.

The yoke enclosure 338 is a generally U-shaped enclosure having opposed side walls 364 and 366 extending upwardly from the bottom wall 350. The walls 364 and 366 include mounting holes, such as a mounting hole 370 in the wall 366, near the top end 344 of the yoke enclosure 338 for securing the mounting plate 342 thereto. The yoke enclosure 338 is adapted to house the magnetron tube 340. The magnetron tube 340 is mounted in the yoke enclosure 338 in the same manner as the magnetron tube 40 is mounted in the yoke enclosure 38 such that an antenna portion 332 extends through the mounting plate 342 of the yoke enclosure 338. When the magnetron tube 340 is operated, heat is generated that tends to radiate outwardly. If the heat that is so generated is not dissipated, the magnetron tube 340 can be damaged. In order to so dissipate such heat, cooling fins 418 are disposed about the magnetron tube 340 and side ends 466 and 468 of the yoke enclosure 338 are open so as to permit air to flow through the yoke enclosure 338 past the cooling fins 418. Unlike the cooling fins 118A–118F, the cooling fins 418 are generally rectangular and are secured to both the magnetron tube 340 and the side walls 364 and 366 of the yoke enclosure 338 because the yoke enclosure 338 is not rotated with respect to the magnetron tube 340.

In order to mount the magnetron assembly 322 to the wall 28 of the waveguide 30, the mounting plate 342 covering the top open end 344 of the yoke enclosure 338 is provided with outwardly extending mounting ears 460–463. Each of the mounting ears 460–463 has holes 465 through which can be extended fasteners (not shown) for securing the mounting plate 342 and thereby the magnetron assembly 322 to the wall 28 of the waveguide 30. As is evident from FIG. 5 of the drawings, the mounting ears 460-463 extend in the same direction as an axis that extends through the open side ends 466 and 468 of the yoke enclosure 338.

The bottom wall 350 of the yoke enclosure 338 has a downwardly extending central flange 372 through which extends the filament stem 354 and which extends into the filter box 600. The filter box 600 is formed of an inner cup 602 and an outer cup 604 and, as will be discussed hereinafter, the inner cup 602 is rotatable with respect to the outer cup 604. The inner cup 602 has an outer peripheral wall 606 extending from a top wall 608 in the center of which is a circular opening 610. The outer cup 604 is similarly shaped with an outer peripheral wall 612 extending from a top wall 614 in the center of which is a circular opening 616.

The outer peripheral wall 606 of the inner cup 602 has an oval shaped opening 618 through which is disposed a feed-thru capacitor 454. The capacitor 454 has a pair of input terminals 456 and 458 that are adapted to be coupled to a source of potential for operating the magnetron tube 340. A pair of connecting terminals 442 and 452 extend from the capacitor 454. The terminal 442 is coupled to one end 440 of choke windings 438 and the terminal 452 is coupled to one end 450 of another choke windings 448. The other end 436 of the choke windings 438 is coupled to a connecting portion 434 of a conductor 430 that extends through the filament stem 354 from the filament (not shown) of the magnetron tube 340. The other end 446 of the choke windings 448 is coupled to a connecting portion 444 of a conductor 432 that extends through the filament stem 354 from the filament (not shown) of the magnetron tube 340.

The outer peripheral wall 612 of the outer cup 604 has an elongated oval shaped opening 620 that extends over an arc of about 130 degrees in the outer peripheral wall 612. As will be discussed in more detail hereinafter, the opening 618 in the wall 606 of the inner cup 602 is adapted to positioned in alignment with the opening 620 in the wall 612 of the outer cup 604 so that the inner cup 602 together with the feed-thru capacitor 454 can be rotated into various positions relative to the yoke enclosure 338.

In order to install the filter box 600 including specifically the inner cup 602 and the outer cup 604, the outer cup 604 is disposed so that the flange 372 will extend through the central opening 616 in the top wall 614 of the outer cup 604. The outer cup 604 is positioned about the flange 372 such that the center of the elongated slot 620 will be in line with a line drawn from a corner 622 (FIG. 6) of the intersection of the bottom wall 350 and the side wall 366 to the center of the bottom wall 350. A Teflon washer 624 is positioned about the flange 372 so as to be disposed against the upper wall 614 of the outer cup 604.

Thereafter, the inner cup 602 is positioned within the outer cup 604 with the central opening 610 disposed about the flange 372. When so positioned, the Teflon washer 624 will be lying between the top wall 614 of the outer cup 604 and the top wall 608 of the inner cup 602. Another Teflon washer 626 is positioned about the portion of the flange 372 extending through the central opening 610 of the inner cup 602. The Teflon washer 626, the inner cup 602, the Teflon washer 624 and the outer cup 604 are secured about the flange 372 by a serrated washer 628 that includes resilient fingers 630 that are forced against the outer surface of the flange 372. However, the washers 624 and 626 on either side of the top wall 608 of the inner cup 602 permits the inner cup 602 to be rotated with respect to the outer cup 604 and the yoke enclosure 338.

The inner cup 602 is rotated with respect to the outer cup 604 until the opening 618 in the side wall 608 is in alignment with the elongated opening 620 in the side wall 612 of the outer cup 604. Preferably, the inner cup 602 is positioned so that the center of the opening 618 is in alignment with the corner 622 of the yoke enclosure 338. When so positioned, the windings 438 and 448 extending from the capacitor 454 and a reduced portion 632 of the capacitor 454 are installed through the aligned openings 606 and 618 until an edge 634 of an enlarged portion 636 of the capacitor 454 abuts against the outer wall 606 of the inner cup 602. A looped end 436A of the end 436 of the choke windings 438 is connected through the connecting portion 434 of the conductor 430 and a looped end 446A of the end 446 of the choke windings 448 is connected through the connecting portion 444 of the conductor 432. Once the choke windings 438 and 448 are so coupled to the conductors 430 and 432 respectively, a cover 638 is secured to the wall 612 of the outer cup 604 enclosing the bottom portion of the filter box 600.

As can be appreciated, the inner cup 602 with the capacitor 454 secured thereto can be rotated with respect to the outer cup 604 and thereby the yoke enclosure 338 to at least the extent of the elongated opening 620 in the outer wall 612 of the outer cup 604. The elongated opening 620 extends a sufficient arcuate distance along the outer wall 612 such that the inner cup 602 can be rotated so that the terminals 456 and 458 extending from the capacitor 454 can be positioned either in the same direction as an axis extending through the open side ends 466 and 468 of the yoke enclosure 338 or in a direction that is transverse to that axis and the side walls 364 and 366. Consequently, the rotation of the inner cup 602 in this manner permits, along with the use of different mounting plates 342 and 58-62, different mounting configurations for the magnetron assembly 322 vis-a-vis the direction that the terminals 456 and 458 extend, of the air flow path through the open side ends 466 and 468 of the yoke enclosure 338 and that the mounting ears 460-463 on the mounting plate 442 extend.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A magnetron assembly that is adapted to be mounted in a microwave oven, said magnetron assembly comprising:

an enclosure means in which is disposed a magnetron tube with cooling fins affixed to said magnetron tube, said enclosure means having a top end and side ends through which air can flow through said enclosure means and past said cooling fins;

mounting plate means disposed in said top end of said enclosure means, said mounting plate means having mounting means for securing said magnetron assembly in said microwave oven; and filter box means mounted with respect to said enclosure means with said filter box means and said enclosure means being rotatable with respect to each other.

2. A magnetron assembly as set forth in claim 1 wherein said enclosure means is generally U-shaped with an open top end and with opposite open side ends and wherein said magnetron tube includes an anode assembly disposed within said enclosure means, said cooling fins being circular in shape and being attached to said anode assembly so that said enclosure means can be rotated with respect to said cooling fins.

3. A magnetron assembly as set forth in claim 1 wherein said filter box means is secured to said enclosure means by securing means such that said enclosure means is permitted to be rotated with respect to said filter box means resulting in input power terminals projecting from said filter box means being positioned with respect to said side ends of said enclosure means.

4. A magnetron assembly as set forth in claim 3 wherein said securing means includes a serrated washer maintained about a flange extending from said enclosure means into said filter box means.

5. A magnetron assembly as set forth in claim 3 wherein said securing means includes detent means to maintain said enclosure means and said filter box means in positions relative to each other.

6. A magnetron assembly as set forth in claim 5 wherein said detent means includes detents adapted to be positioned within detent recesses in said enclosure means to maintain said enclosure means and said filter box means in selected positions relative to each other.

7. A magnetron assembly as set forth in claim 1 wherein said mounting means includes mounting ears projecting from said mounting plate means for mounting said magnetron assembly in said microwave oven and wherein said mounting plate means is detachably secured in said top end of said enclosure means so that said magnetron assembly can have different mounting configurations.

8. A magnetron assembly as set forth in claim 1 wherein said enclosure means has opposed side walls with first mounting holes adjacent said top end and said mounting plate means has depending skirts with second mounting holes, said depending skirts being adapted to be disposed in said top end of said enclosure means such that said first and second mounting holes are in alignment so that said mounting plate means can be secured in said top end of said enclosure means.

9. A magnetron assembly as set forth in claim 1 wherein said filter box means is generally rectangular in shape with an open bottom portion and includes a filter box cover to enclose said open bottom portion.

10. A magnetron assembly as set forth in claim 1 wherein filter box means includes an inner cup means and an outer cup means, said inner cup means being rotatable with respect to said outer cup means.

11. A magnetron assembly as set forth in claim 10 wherein said inner cup means has terminal means extending from a first outer wall thereof and said outer cup means includes an elongated opening in a second outer wall so that as said inner cup means is rotated with respect to said outer cup means said terminal means is selectively positioned through said elongated opening.

12. A magnetron assembly as set forth in claim 11 including rotating means adjacent said inner cup means to permit said inner cup means to rotate with respect to said outer cup means.

13. A magnetron assembly as set forth in claim 12 wherein said outer cup means has a first top wall having a first opening that is positioned about a flange portion projecting from said enclosure means, wherein said inner cup means has a second top wall having a second opening that is positioned about said flange portion, wherein said rotating means includes first and second washer means disposed on either side of said second top wall about said flange portion and including a serrated washer about said flange portion to maintain said inner and outer cup means relative to said enclosure means.

14. A magnetron assembly as set forth in claim 10 including filter box cover means to enclose said inner cup means within said outer cup means.

15. A magnetron assembly that is adapted to be mounted in a microwave oven, said magnetron assembly comprising:

an enclosure means in which is disposed a magnetron tube, said enclosure means having a top end and side ends through which air can flow through said enclosure means;

mounting plate means detachably disposed in said top end of said enclosure means, said mounting plate means having mounting means for securing said magnetron assembly in said microwave oven; and filter box means secured to said enclosure means so that said enclosure means can be rotated with respect to filter box means.

16. A magnetron assembly as set forth in claim 15 wherein said filter box means has a opening through which extends a flange portion projecting from said enclosure means and including securing means to secure said opening about said flange portion such that said enclosure means is permitted to be rotated with respect to said filter box means resulting in input power terminals projecting from said filter box means being positioned with respect to said side ends of said enclosure means.

17. A magnetron assembly as set forth in claim 15 including cooling fins disposed about said magnetron tube such that said air flowing through said enclosure means flow past said cooling fins, said cooling fins having a circular outer edge that is separated from the enclosure so that the enclosure can be rotated about said cooling fins.

18. A magnetron assembly for mounting in a microwave oven, said magnetron assembly comprising:

an enclosure means in which is disposed a magnetron tube, said enclosure means having a top end and side ends through which air can flow through said enclosure means;

mounting plate means detachably disposed in said top end of said enclosure means, said mounting plate means having mounting means for securing said magnetron assembly in said microwave oven; and inner cup means and outer cup means mounted on said enclosure means for containing filter means including input terminals, said inner cup means being rotatable with respect to said outer cup means so that said terminals can be disposed in selected positions relative to said enclosure means and said mounting plate means.

19. A magnetron assembly as set forth in claim 18 wherein said outer cup means has a first top wall having a first opening that is positioned about a flange portion projecting from said enclosure means, wherein said inner cup means has a second top wall having a second opening that is positioned about said flange portion and including first and second washer means disposed on either side of said second top wall about said flange portion to permit said inner cup means to rotate with respect to said outer cup means and including a serrated washer about said flange portion to maintain said inner and outer cup means relative to said enclosure means.

20. A magnetron assembly as set forth in claim 18 wherein said input terminals project from a first outer wall of said inner cup means and said outer cup means includes an elongated opening in a second outer wall so that as said inner cup means is rotated with respect to said outer cup means said terminal means is selectively positioned through said elongated opening.

* * * * *